US005979901A

United States Patent [19]

Resimont

[11] Patent Number: 5,979,901

[45] Date of Patent: Nov. 9, 1999

[54] STRING GAME AND METHOD OF PLAY

[76] Inventor: William N. Resimont, 13403 Peachwood Ct., Fairfax, Va. 22033

[21] Appl. No.: 09/094,491

[22] Filed: Jun. 10, 1998

Related U.S. Application Data

[60] Provisional application No. 60/049,278, Jun. 10, 1997.

[51] Int. Cl.[6] ..... A63F 9/00

[52] U.S. Cl. ..... 273/447

[58] Field of Search ..... 273/440, 441, 273/447, 448, 459

[56] References Cited

U.S. PATENT DOCUMENTS

| | | | |
|---|---|---|---|
| 254,430 | 2/1882 | Crandall | 273/447 |
| 1,885,260 | 11/1932 | Hoglind | 273/447 |
| 3,617,057 | 11/1971 | Goldfare | 273/447 |
| 3,771,793 | 11/1973 | Kraemer | 273/459 X |
| 4,863,164 | 9/1989 | Mizunuma . | |
| 4,944,512 | 7/1990 | Mauck et al. | 273/447 |
| 4,961,580 | 10/1990 | Yoe et al. . | |
| 5,028,047 | 7/1991 | Lee et al. . | |
| 5,102,148 | 4/1992 | Mizunuma . | |

*Primary Examiner*—William H. Grieb
*Attorney, Agent, or Firm*—Frederick F. Tsung

[57] ABSTRACT

A pick-up game includes a plurality of elongated strands each having an identical bead attached to one end. Attached to the other end of each strand is an animal shaped figure of a distinct color. Each strand and its attachments constitute a game piece. The object of the game, which is played by more than one player, is to choose a bead and withdraw the strand to which that bead is attached (from a pile formed from a plurality of game pieces) in the hope of pulling out a game piece that matches the game piece originally selected by each player at the beginning of the game. When a newly selected game piece is dissimilar to the game piece originally selected by the player, the newly selected game piece is returned to the pile taking care not to disturb the random order of the game pieces. The players continue to alternately withdraw game pieces from the pile until one player becomes the winner by being the first to successfully withdraw all the game pieces matching the originally selected game piece. The game is started by players randomly choosing game pieces, thereby assigning a different game piece set to each player.

6 Claims, 1 Drawing Sheet

STRING GAME AND METHOD OF PLAY

This appln the benefit of U.S. Provisional Appln Ser. No. 60/049,278, filed Jun. 10, 1997.

BACKGROUND OF THE INVENTION

1. Field of the Invention

The present invention relates to a game and more specifically to a string game and its method of play.

2. Description of Related Art

Games involving the picking up of objects have been known for some time. A well known game involves the picking up of sticks. There a plurality of sticks and a single uniquely identifiable stick are bundled together parallel to one another and held upright upon and perpendicular to a planar playing surface such as, for example, a floor or a table top. The sticks are then released and fall into a pile on the surface in a generally random order. The object of the game is to remove sticks (picking them up or sliding them out) from the pile without disturbing the remaining sticks. A starting player is chosen and that player must draw a stick from the pile. Once the uniquely identifiable stick is selected, the stick can be used as an aid in removing other sticks. Sticks are removed by a player until the player moves one or more adjacent sticks during an attempt to remove a particular stick. Leaving the stick that disturbed the other sticks in position, the next player attempts to withdraw a stick from the pile. The player with the most sticks when the pile has been depleted wins the game. Alternative variations of the game provide point totals for differently marked sticks, which vary in number.

Other prior art pick up games use a variety of tools and apparatus to gather various objects. One prior art pick up game uses an apparatus that includes a pair of supporters each of which has a pair of pinchers which are manipulated by a trigger such that two players using the supporters can pick up string objects and place them in holding areas.

In another prior art pick up game, players use a suction cup plunger having a hollow shaft handle which the player uses to pick balls of a preselected color out of a bathtub as the balls are rotated around by an impeller.

In still another prior art pick up game, pick up hooks are provided for each player and used to pick up objects which undergo compound movement. The objects are shaped like monsters with elastic arms capable of being grasped by the pick up hooks.

In yet another prior art pick up game, played in the dark and having two versions, players use implements to pick up game pieces. The game pieces briefly radiate color coded visible light after receiving a flash of the type commonly used and applied by cameras. In the first game, colored worms are picked up before the color has faded by using a pickup hook. In the second game, colored dumplings are picked up, using chopsticks, before the color has faded.

Examples of some of the aforementioned prior art games can be found in U.S. Pat. Nos. 4,863,164, 4,961,580, 5,028,047, and 5,102,148.

There remains a need for additional object collecting games that provide new, entertaining, and educationally developmental ways of collecting the objects. None of the above inventions and patents, taken either singly or in combination, is seen to describe the instant invention as claimed.

SUMMARY OF THE INVENTION

The invention is a pick-up game that includes a plurality of elongate strands each having an identical bead attached to one end. Attached to the other end of each strand is an animal shaped figure or other distinctively shaped and/or colored object. Each strand and its attachments constitute a game piece. The game includes sets of game pieces which are distinguishable from one another either by shape or color. The object of the game, which is played by more than one player, is to choose a bead and withdraw the strand to which that bead is attached (from a pile formed from a plurality of game pieces) in the hope of pulling out a game piece that matches the game piece originally selected by each player at the beginning of the game. To increase the chance of choosing the correct game piece, a player locates within the pile of game pieces, one of the game pieces that matches the game piece originally selected by the player. The player visually follows the strand of the game piece to the one end having the bead attached thereto and, upon grabbing the bead attached to the game piece, pulls the game piece out of the pile. If at any time during play a game piece which is dissimilar to the originally selected game piece is withdrawn from the pile of game pieces, that game piece is returned to the pile taking care not to disturb the random order of the game pieces. The players continue to alternately withdraw game pieces from the pile until one player becomes the winner by being the first to successfully withdraw all the game pieces matching the originally selected game piece. The game is started by players randomly choosing game pieces, thereby assigning a different game piece set to each player.

Accordingly, it is a principal object of the invention to provide an object collecting game that teaches new, entertaining, and educationally developmental ways of collecting the objects.

It is another object of the invention to provide an object collecting game that teaches the rudiments of set theory.

It is a further object of the invention to provide an object collecting game that teaches and develops visual tracing.

Still another object of the invention is to provide game pieces particularly well suited to teach the aforementioned set theory and visual tracing.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
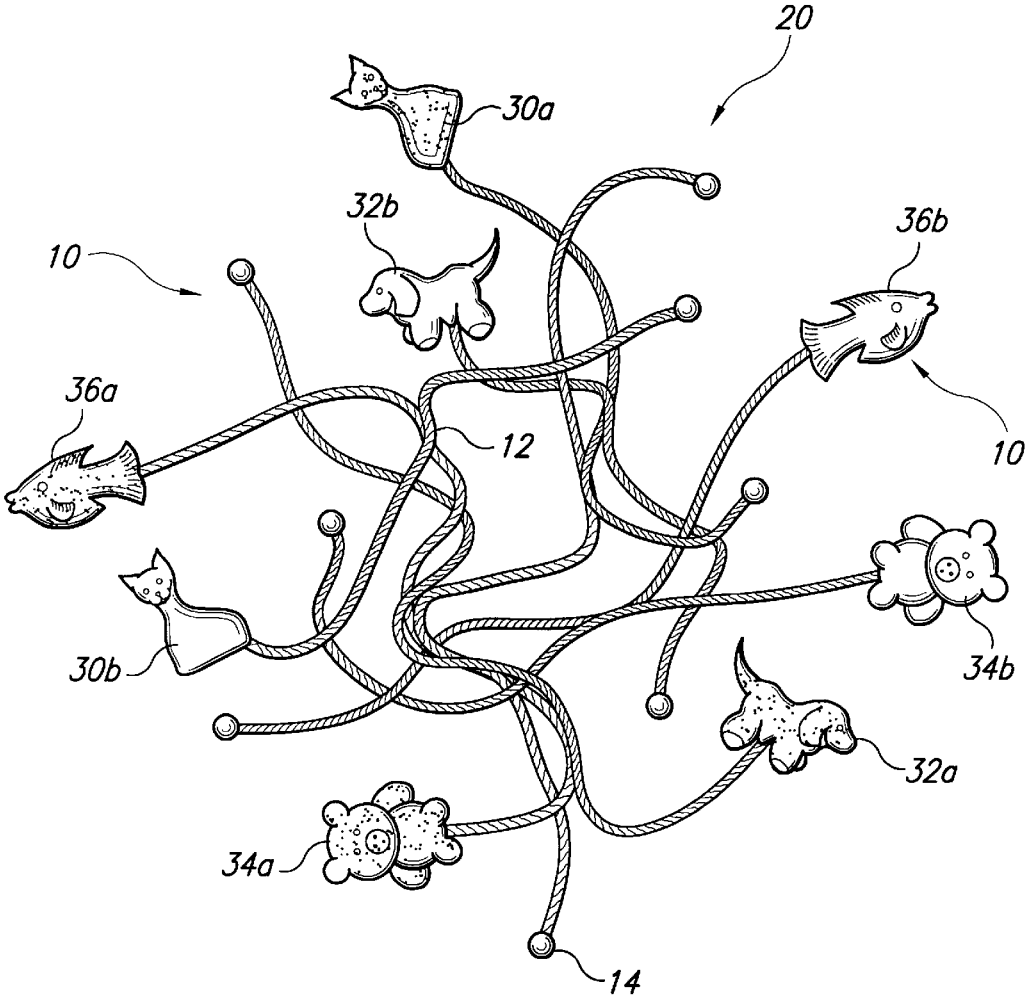
FIG. 1 is a top view of a pick up game according to the present invention.
Figure 2:
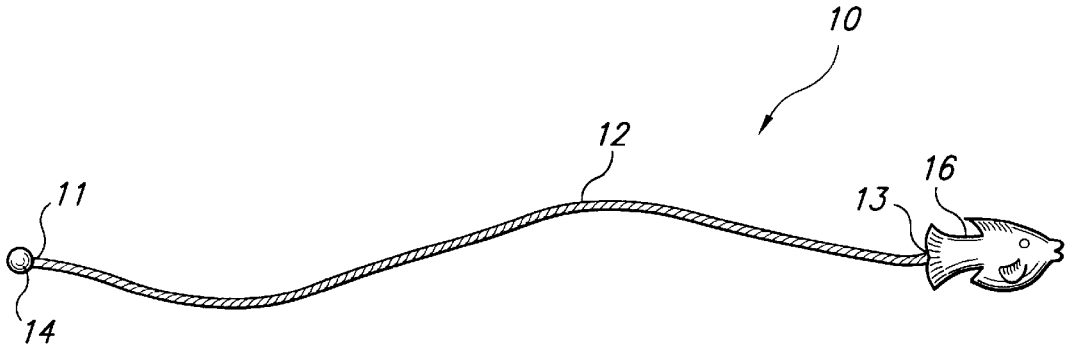
FIG. 2 is a perspective view of a game piece according to the present invention.

Referring to FIGS. 1 and 2, the present invention is pick up game which utilizes a plurality of game pieces 10. Each game piece 10 comprises an elongated strand 12, a common object 14 attached to one end 11 of the strand 12, and an identifier object 16 attached to the other end 13 of the strand 12. In the embodiment shown, the strand 12 is formed of a braided string or rope, the common object 14 is a bead, and the identifier object 16 is a colored bead having a unique shape such as that of any one of a variety of animals (i.e., a cat, a fish, a dog, a bear, etc.).

Referring specifically to FIG. 1, each set of game pieces is distinguishable from another set either by shape or color. The plurality of game pieces 10 in FIG. 1 include four groups each having two identifier objects of the same shape yet differing in color. Shown are: two cats 30*a,* 30*b;* two dogs 32*a,* 32*b;* two bears 34*a,* 34*b;* and two fish 36*a,* 36*b.* The purpose of such an arrangement is to illustrate how different characteristics of the identifier object 16 can be selected as that characteristic which makes a number of game pieces a set.

For example, the game may be played by two players, where one player's set has identifier objects 16 of the same color (although different in shape) and the other player's set has identifier objects 16 of a different color (also different in shape). Therefore, one player has four game pieces {a cat 30*a,* a dog 32*a,* a bear 34*a,* and a fish 36*a*} within their set the other player has four game pieces {a cat 30*b,* a dog 32*b,* a bear 34*b,* and a fish 36*b*} within their set and color is the determining characteristic.

Alternatively, the game may be played by four players where each player's set of game pieces 10 have identifier objects 16 of the same shape although different in color. Therefore, all four players have two game pieces, either {30*a,* 30*b*}, {32*a,* 32*b*}, {34*a,* 34*b*}, or {36*a,* 36*b*} within their set and shape is the determining characteristic.

The numbers and types of shapes and colors used for identifier object 16 and the common object 14 are not intended to be limited in any way by the example described. It should be apparent, therefore, that any number of color and shape combinations may be provided to produce as many sets as desirable for a number of players. Furthermore, it should be apparent that the number of game pieces preferably will be larger than the number shown in FIG. 1 in order to render the game more difficult. Fewer game pieces have been shown in FIG. 1 to simplify the description of the game and its rules.

The pick up game is played in the following manner by a plurality of players. A player is chosen to take their turn first and an order in which the remaining players will take their turns is agreed upon by the players.

A first player wads or otherwise co-mingles the game pieces 10 and places them in a pile 20 on a flat surface such as a table or the floor. The first player grabs a common object 14 of one game piece 10 and pulls the game piece out of the pile 20. The identifier object 16 at the end 13 of the selected game piece 10 is that player's identifier object (i.e. a cat 30) for the rest of the game. After one game piece 10 is pulled out of the pile 20, a player's turn is over.

A second player also grabs the common object 14 of one game piece 10 and pulls the game piece out of the pile 20. If the identifier object 16 is not another player's identifier object (i.e. the cat 30, supposing shape has been chosen as the determining characteristic in set formation), then identifier object 16 is the current player's identifier object 16 (i.e. a bear 34) for the rest of the game. If the identifier object 16 is already dedicated to another player (i.e. the cat), then the game piece 10 is laid back on top of the pile 20 without disturbing the other game pieces and the player's turn is over.

When a player, who already has selected their identifier object 16, takes their next turn, that player locates one of their identifier objects 16 located within the pile 20. The player visually follows the stand 12 of the game piece 10 from end 13 to end 11, grabs the common object 14 thereon and pulls the game piece 10 out of the pile 20. If the game piece 10 has their identifier object 16 attached thereto, the player keeps the game piece 10 and their turn is over. If the identifier object 16 belongs to another player, the game piece 10 is laid back on top of the pile 20 without disturbing the other game pieces and the player's turn is over.

Play continues until a player gathers all of the game pieces having their identifier object 16 from the pile 20, the first player to do so wins the game.

It is to be understood that the present invention is not limited to the sole embodiment described above, but encompasses any and all embodiments within the scope of the following claims.

I claim:

1. A pick up game comprising a plurality of game pieces, each said game piece having an elongated strand, a common object attached to one end of said strand, and an identifier object attached to the other end of said strand; and said plurality of game pieces including at least two sets of game pieces, each of said at least two sets of game pieces being distinguishable from one another.

2. The pick up game according to claim 1, wherein said common object is a bead secured to said one end of said strand.

3. The pick up game according to claim 1, wherein said elongated strand is a flexible rope.

4. The pick up game according to claim 1, wherein each of said at least two sets of said game pieces are distinguishable from one another by having a unique identifier object.

5. The pick up game according to claim 4, wherein said identifier object is a colored bead in the shape of an animal.

6. A method of playing the pick up game according to claim 1, comprising the steps of:

a) choosing which player will take their turn first and the order in which the remaining players will take their turns;

b) wadding up the game pieces and dropping them into a pile on a flat surface;

c) playing a first round by:

1) having the first player grasp a common object of a selected game piece and pull the game piece from the pile, whereby the identifier object at the other end of the selected game piece is the players identifier object for the remainder of the game and the player's turn is over; and 2) having subsequent players grasp a common object of a different game piece and pull the game piece out of the pile, whereby if the identifier object is not the same as the identifier object of a different player, the identifier object is the current player's identifier object for the rest of the game, and if the identifier object belongs to a different player, the game piece is laid back on top of the pile without disturbing the other game pieces and the player's turn is over;

d) playing subsequent rounds by having each player select another game piece, whereby if the game piece has their identifier object attached thereto, the player keeps the game piece and their turn is over, and if the identifier object is a different player's the game piece is laid back on top of the pile without disturbing the other game pieces and the player's turn is over; and e) continuing until one player gathers all of the game pieces having their identifier object from the pile, thereby winning the game.

* * * * *